United States Patent [19]

Kinh et al.

[11] 3,947,331

[45] Mar. 30, 1976

[54] METHODS FOR FORMING AN ELECTROLYTIC DEPOSIT CONTAINING MOLYBDENUM ON A SUPPORT AND THE PRODUCTS OBTAINED THEREBY

[75] Inventors: Vu Quang Kinh, Paris; Jean Montuelle, Bourg-la-Reine, both of France

[73] Assignee: Agence Nationale De Valorisation De La Recherche (ANVAR), France

[22] Filed: June 18, 1973

[21] Appl. No.: 370,629

Related U.S. Application Data

[63] Continuation-in-part of Ser. No. 202,011, Nov. 24, 1971, abandoned.

[30] Foreign Application Priority Data

Feb. 21, 1973 France ..... 73.06047

[52] U.S. Cl. ..... 204/37 R; 204/38 B; 204/43 T; 204/40; 204/43 R

[51] Int. Cl.[2].... C25D 5/50; C25D 3/56; C25D 5/10

[58] Field of Search..... 204/40, 43 R, 37, 37 R, 204/38 B, 44, 43 T

[56] References Cited

UNITED STATES PATENTS

| | | | |
|---|---|---|---|
| 734,522 | 7/1903 | Edison | 204/37 R |
| 2,156,262 | 5/1939 | Fink et al. | 204/37 R |
| 2,599,178 | 6/1952 | Holt et al. | 204/43 T |
| 2,653,128 | 9/1953 | Brenner et al. | 204/43 T |

OTHER PUBLICATIONS

"Electrodeposition of Alloys" by Abner Brenner, Vol. 1, 1963, p. 122.

"Modern Electroplating" by Lowenheim, 2nd Ed., 1963, pp. 288–289.

"Electrodeposition of Mo Alloys From Aqueous Solutions" by D. W. Ernst et al., J. Electro Chem. Soc., Aug. 1955, pp. 461–469.

Principles of Electroplating and Electroforming by Blum et al., 3rd Ed. 1949, pp. 67, 129.

Modern Electroplating by Lowenheim, 2nd Ed., 1963, p. 41.

*Primary Examiner*—R. L. Andrews

*Attorney, Agent, or Firm*—Larson, Taylor and Hinds

[57] ABSTRACT

The molybdenum is deposited with at least one transition metal. The support is placed at the cathode and the bath in which this cathode is immersed contains at least one compound of molybdenum and at least one compound of the transition metal. The bath contains a mixture of an alkaline molybdate of a transition metal salt and of an alkaline salt of an organic acid with a mixed acid-alcohol function, this salt being able to give complexes with the molybdenum and transition metal ions of the other constituents. The pH and the temperature of the bath are kept compatible with the stability of these complexes. A cathodic current density greater than a "fissuration threshold" is used and the electro-deposition treatment is carried out for a duration which must be less than a "scaling duration". Each layer of alloy deposited electrolytically on the sub-adjacent support is subjected to heat treatment in a non oxidizing medium at a temperature between 700°C and 1200°C and compatible with the preservation of the properties of the support, this heat treatment being effected for between 2 and 24 hours.

20 Claims, 1 Drawing Figure

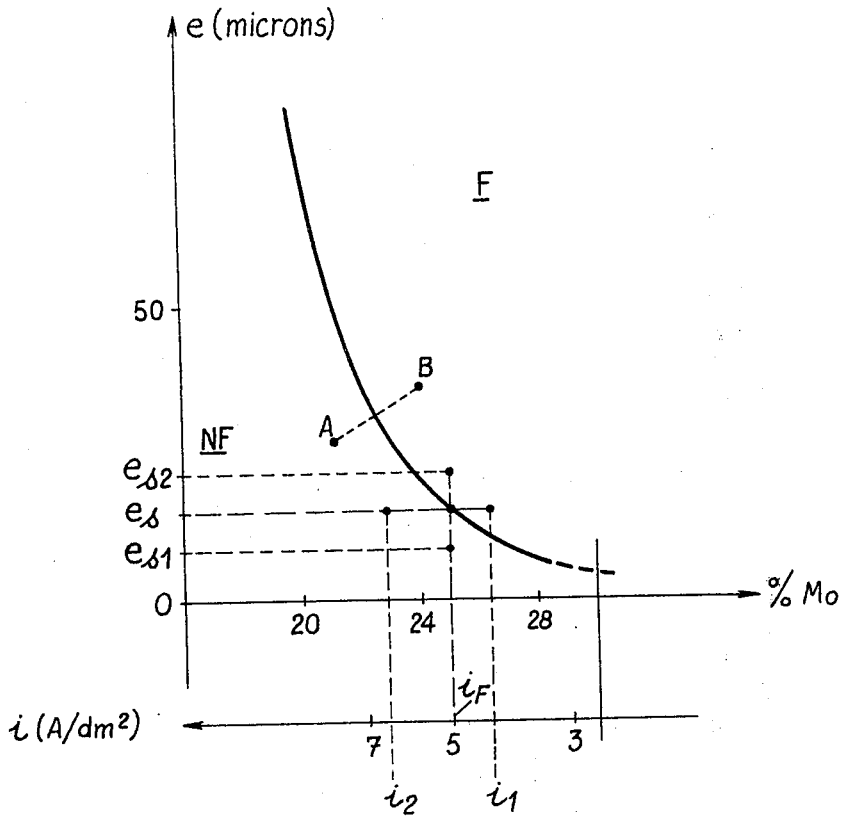
e (microns)
F
50
B
A
NF
$e_{\delta 2}$
$e_{\delta}$
$e_{\delta 1}$
0
20
24
28
% Mo
$i_F$
i (A/dm²)
7
5
3
$i_2$
$i_1$

METHODS FOR FORMING AN ELECTROLYTIC DEPOSIT CONTAINING MOLYBDENUM ON A SUPPORT AND THE PRODUCTS OBTAINED THEREBY

The present application is a continuation in part of application Ser. No. 202,011 filed Nov. 24, 1971, and now abandoned.

BACKGROUND OF THE INVENTION

The invention relates to electrodeposition of molybdenum and at least one other metal on a material adapted to resist the mechanical fatigue to which this support will be exposed under conditions of use, but incapable, on the other hand, of resisting physico-chemical attack (especially corrosion in an acid environment). The material of the support should either be electrically conductive material, or be rendered superficially conductive. Examples of such materials are pure and alloyed iron, ordinary steels, slightly alloyed steels, special steels (stainless steels, "Maraging" steels, etc.), nickel and its alloys ("Inconel", "Monel", "Hastelloy", etc.), copper and cobalt, as well as the respective alloys of these two metals, titanium and metals of the same group, as well as their alloys, and ceramics rendered conductive by a suitable coating (graphite for example).

The good mechanical properties and resistance to hot corrosion which are offered by certain nonferrous nickel base (maximum 65%) and molybdenum base (maximum 30%) alloys, possibly containing chromium, are well known. However, these alloys have not been developed industrially as warranted by their properties and this may be due to their high price and to the difficulties presented in their use.

As a consequence, there is much interest in constituting a part of a material different from such alloys of molybdenum and depositing on this part, forming a support, a coating containing molybdenum which confers superficially on the part the properties of corrosion resistance of the molybdenum alloys.

Attempts were made in the past taking into account, of course, the impossibility of electrodepositing molybdenum alone, in an aqueous medium, on a support of metal or alloy; deposition of molybdenum by such a route is only realizable in association with at least one other metal, called "transition metal", adaptable to electrolytic deposition; such a transition metal can be, especially, iron, cobalt, or, even better, nickel whose association with molybdenum then enables reconstitution, in the electrodeposited layer, of the advantageous characteristics of the non-ferrous molybdenium-base alloys whose high price and difficulties of application have impeded development.

However, it should be noted, and this is of cardinal importance, that the attempts mentioned in the preceding paragraph had a more theoretical objective (verification of the role of the transition metal) than practical, the quality of the alloy layers thus deposited (alloy of molybdenum and transition metal) not having formed the subject of industrial research and development.

The codeposits of molybdenum and nickel, effected in the past by conventional electrolytic methods, have given rise to crude coating layers of little mechanical strength, porous and fissured, these defects being incompatible with any practical industrial application of such a method considering that the essential role of a coating of molybdenum and nickel is to protect, against physico-chemical attack and for as long a duration as possible, the support on which this coating is deposited, which obviously cannot be formed as a fragile, porous and fissured deposit.

SUMMARY OF THE INVENTION

It is a particular object of the invention to provide a method for electrodepositing, on a suitable support, a coating of molybdenum and at least one transition metal having a high mechanical strength and which is free of porosity and fissuration, that is to say in the form of a coating which actually protects underlying support.

An electrolytic method according to the invention for producing, on an electrically conductive support, a deposit of molybdenum and at least one transition metal comprises making the support cathodic in a bath which consists of an aqueous solution of an alkali metal molybdate, a transition metal salt and an alkali salt of an organic acid with mixed acid-alcohol functional groups. The pH of the bath is from 9 to 11 and the temperatue is above 20°C and low enough not to destroy the complexes of the organic acid salt and the Mo and transition metal ions. A temperature of about 40°C appears preferable although the full range from 30°C to 60°C is generally quite satisfactory. The cathodic current density is selected as a function of the composition of the bath and, for a given bath, should exceed a "fissuration threshold" $i_s$ which will be defined later and is a decreasing function of the molybdenum content of the layer. The cathodic current density is selected for the field to be as high as possible.

The alkali metal is preferably sodium, although lithium and potassium may sometimes be used. The salt of an organic acid is preferably sodium citrate, but tartrates and acetates may sometimes be used as well. The transition metal salt may include one or more of the transition metal salts from the group chloride, sulfate and sulfamate. The total molar concentration of the nickel salts may be within the range 0.06–0.25 mole/l (corresponding to the range 15–60 g/l if nickel chloride is used). The alkali metal molybdate may be in the range 0.008–0.05 mole/l (corresponding to 2–12 g/l if sodium molybdate is used).

Several possibilities are open: first, a single non-fissured layer can be electrodeposited on the support. However, it is then hardly possible to exceed an overall thickness of 80 $\mu$m for the coatings rich in Mo. Also, a fissured layer (i.e. a layer having microcracks) may be deposited on the support, and then a non-fissured layer on the first. Last, more than two layers may be successively deposited under different operating conditions for providing a coating which will be "referred" to in the following as a "multilayer coating". In that case, the current density and/or the thickness of each layer may be so selected that a layer deposited under conditions so that it is not fissured (i.e. under the conditions set out above), is in contact with or sandwiched between other layers deposited under different conditions. The average Mo content of a multilayer coating of a predetermined thickness may be in excess to that which is attainable with a single non-fissured layer of same thickness and this constitutes a substantial advantage as regards resistance to corrosion. Some of the alternate layers may be closer to the fissuration threshold than the other layers or may even be fissured.

Usng the latter approach makes it possible to increase the overall thickness of the coating from a maximum value in the 80 microns range for a single layer in a typical case to a value which may be as high as 250 microns, whereby the protection of the underlying support is substantially increased. As a result, it may often be possible to dispense with final heat treatment for use in a moderately aggressive environment. In general, elementary successive layers each having a thickness from 1 to 5 microns provide satisfactory "multilayer" coatings, while in certain cases a thickness up to 10 microns is perfectly acceptable.

As indicated hereinbefore, nickel, cobalt, chromium and tungsten constitute transition metals to be considered for codeposition. However, certain of them are of particular interest.

Some conditions of operation are not critical; for instance the temperature may vary without broad limits, and it may be simpler to operate at ambient temperature. As a general rule, a temperature between 30°C and 60°C can be considered as providing satisfactory results. The transition metal will generally be present partially or wholly in the form of chloride; said transition metal may also be present partly or in whole in the form of other salts, particuarly sulfate or sulfamate. The use of chloride increases the electrical conductivity of the bath and renders it possible to use a lower interelectrode voltage. When the transition metal is nickel, it is advantageous to include in the bath nickel chloride ($NiCl_2$, $6H_2O$), nickel sulfate ($NiSO_4$, $7H_2O$) or nickel sulfamate, sodium molybdate, ($Na_2MoO_4$, $2H_2O$) and trisodic sodium citrate ($Na_3C_6H_5O_7$, $7H_2O$). For Co–Mo layers, it may be preferable to use baths in which cobalt is partly present in the form of cobalt sulfamate.

BRIEF DESCRIPTION OF THE DRAWING

The only FIGURE of the drawing is a curve which represents the fissuration threshold for a Ni-Mo bath of predetermined composition, the molybdenum content of a layer obtained from the bath being plotted in abcissae while the thickness *e* of the layer is plotted in ordinates

DESCRIPTION OF PREFERRED EMBODIMENTS

Before a full description of particular embodiments is given, it may be useful to provide some general indications.

Referring to the single FIGURE of the drawing, the curve separates two areas. The area F right of the curve corresponds to fissured layers. The area NF left of the curve corrresponds to non-fissured layers. Different curves correspond to different compositions of the bath, but the general shape remains unaltered. The indications given on the curve are by way of examples only and correspond to a Ni-Mo bath having the composition of example 10 referred to later, or to composition AC with the greater part of nickel chloride $NiCl_2$, $6H_2O$ replaced with nickel sulfamate $Ni(NH_2\ SO_3)_2$, $4H_2O$. The lower limit of the cathodic current density which can be used is about 5 A/dm² if the coating consists of a single layer, since for lower current densities the non-fissured layers which can be deposited are too thin. As to the optimum current density which can be used, it is practically within a range limited by two phenomena: the current yield rapidly decreases with a density beyond 10 A/dm² for the bath which is referred to. On the other hand, microscopic pin holes, which may constitute porosities, occur when the current density exceeds about 9 A/dm².

Now, if a single non-fissured layer is to be deposited, the conditions will be selected for the corresponding point to be located in area NF of the single FIGURE. In most cases, the concentrations of the constituents of the bath and the operating conditions will be selected for the coating to contain from 10 to 50% by weight, preferably from 15 to 30% by weight, of molybdenum.

Ni-Mo baths having compositions within the following range, operated at 40°C ± 2°C and having a pH of about 9.5 ± 0.2 have been found satisfactory:

| | |
|---|---|
| nickel chloride ($NiCl_2$, $6H_2O$) : | between 15 and 60 gr/l, |
| nickel sulfate ($NiSO_4$, $7H_2O$) : | between 18 and 72 gr/l the sulfate being then substituted for the chloride (in the case of a mixed bath) by equimolecular quantities, |
| sodium molybdate ($Na_2MoO_4$, $2H_2O$) : | between 2 and 12 gr/l, |
| sodium citrate ($Na_3C_6H_5O_7$, $7H_2O$) : | molar concentration comprised between one and two times that of the total concentration of nickel and of molybdenum and, preferably of the order of 1.25 time this total concentration. |

If the temperature and/or the pH of the bath are modified, within the limits provided above (30°C to 60°C and 9 to 11), the concentrations of nickel and sodium salts, indicated above, will be able to depart by about 20% more or less from the limits indicated.

Different types of anodes may be used, an insoluble anode, for example of platinum; the concentrations of molybdenum and of transition metal in the bath should then periodically be adjusted by suitable additions of the salts of these metals used as constituents of the bath, a soluble anode constituted by an alloy of molybdenum and of the transition metal (for example a molybdenum-nickel alloy having a content of molybdenum corresponding to that desired for the deposit), in which case it is no longer necessary to add salts to the bath periodically.

The pH of the bath is preferably selected between 9 and 11, a value in the neighborhood of 9.5 generally being optimum. The pH of the bath may be adjusted by the addition of ammonia or of soda; the value may be retained by periodical adjustments. Such periodic adjustments result in a constant coating composition and a constant cathodic yield.

The temperature of the bath is preferably held at the selected value for the whole electrodeposition for the coating to have a constant composition throughout its thickness. A value around 40°C provides satisfactory results.

The cathodic current density must be greater than the fissuration threshold; a value approximately equal to 1.25 time the fissuration threshold is generally satisfactory.

On this subject, it is interesting to note that, for molybdenum-nickel baths formed with the previously indicated constituents (nickel chloride and sulfate, sodium molybdate and citrate) provided within the ranges of proportions also indicated, the bath having a temperature of 40°C and a pH of 9.5, the range of cathodic current density being between 5 and 10

A/dm² and the fissuration threshold being then 5 A/dm², an appropriate current density is about 6–7 A/dm².

Such a cathodic current density provides a layer free of fissures which resists corrosion and is firmly anchored to the support; that layer may have a thickness up to and beyond 50 microns, according to the duration of the electro-deposition treatment; the optimal thickness of the layer appears to be from 30 to 40 microns.

Lastly, the duration of the electro-deposition is preferably selected at a value approximately equal to three-fourths of the scaling duration for the formation of each layer of deposit, which scaling duration depends on the cathodic current density.

To establish ideas on the subject of the relation existing between the cathodic current density and the duration of treatment, it is interesting to note that, for molybdenum-nickel baths having the constituents and the ranges of proportions indicated, the duration of treatment, with a current density in the neighborhood of the fissuration threshold, must be less than about 150 minutes (scaling duration), the above-said treatment duration being then advantageously of the order of 60 to 90 minutes.

The coating may then be subjected to a final thermal treatment which increases the corrosion resistance and the adherence to the support; the part coated with the layer of electrolytically deposited alloy is subjected to a thermal treatment conducted in a non-oxidizing medium at a temperature comprised between 700°C and 1200°C and not detrimental to said support, the duration of this thermal treatment being comprised between 2 and 24 hours.

The beneficial effects of such a thermal treatment comprise elimination of gases and internal stresses in the deposited layer, improvement in the crystallization of the layer, and partial diffusion of the elements of the layer into the support.

The non-oxidizing atmosphere for this thermal treatment may be inert gas free of oxygen (argon for example), or a vacuum of at least $10^{-5}$ torr.

The temperature rises preferably at a moderate speed (10°C to 30°C per minute), the cooling being possibly done much more rapidly (5°C to 300°C per second).

If the mechanical propertis of the support are found to be altered by the thermal treatment which has just been considered, these mechanical properties will be restorable, if this is indispensible, by one or several other later heat treatments.

Now having given the specifications on the subject of the final heat treatment enabling the improvement of the qualities of the molybdenum-transition metal (especially molybdenum-nickel) electrolytic deposits, effected on the support to be protected, there will now be discussed a certain number of features enabling the abovesaid supports to withstand this final heat treatment better.

According to one of these features, the deposit of the layer of non-fissured alloy is preceded by the deposit of a layer of fissured alloy, obtained by using the same bath composition but with a cathodic current intensity less than the fissuration threshold (which density is comprised between 2.5 and 4.5 A/dm², and preferably of the order of 4 A/dm² when it relates to a bath of the types envisaged for which the fissuration threshold is situated towards 5 A/dm²), the beneficial effect of this fissured sub-layer being due to the fact that the inner stresses are considerably relaxed in such a sub-layer whose thickness is then preferably of the order of 10 to 40 microns.

According to another of said features, the risks of diffusion of undesirable elements (from the support towards the molybdenum-transition metal alloy coating) is avoided during the heat treatment effected after the electro-deposition treatment, by forming initially on the support a deposit of a sub-layer of at least one metal (copper, cobalt, nickel, etc.), capable of playing the role of diffusion barrier with respect to the above-said undesirable elements.

The deposit of this sub-layer may be effected by a physical method (spraying for example), chemical or better still electrolytic, the abovesaid sub-layer having advantageously a thickness of 5 to 30 microns.

It should be noted that it is quite possible to combine the two features which have just been considered and to result thus in the following operational procedure:

deposition of a sub-layer of a metal (especially nickel) forming a diffusion barrier, this sub-layer, of which the thickness is preferably comprised between 5 and 30 microns, being advantageously formed by an electrolytic method;

deposit of a fissured layer of molybdenum-transition metal alloy (molybdenum-nickel especially), this layer being able to have a thickness of the order of 10 to 40 microns;

deposition of a non-fissured layer of the same alloy with a thickness preferably of the order of 30 to 40 mirons;

improvement of the multiple coating thus formed, by a final heat treatment such as previously described.

It should be noted that, whatever the number of layers already formed, there may, if desired, be formed supplementary layers by proceding, on the layers thus formed, with an annealing effected at a temperature comprised between 150°C and 350°C for a period comprised between 30 minutes and 3 hours, this annealing treatment to be, preferably, effected under high vacuum ($10^{-5}$ torr for example) or in an inert gas (argon for example).

There will now be given, to conclude, a certain number of examples intended to illustrate in precise manner the previously explained features, which are not of course intended to be limiting.

For all these examples, there was used a soluble anode, constituted of a molybdenum-nickel alloy, the coating to be effected by electrolytic deposition being a binary molybdenum-nickel alloy.

For all these examples also, the temperature of the bath was 40°C (+ or − about 2°C) and its pH 9.5 (+ or − about 0.2).

The baths used are denoted in the following Table by the abbreviated designations A.C.; A.C.S.; A.S.; B.C.; B.C.S. and B.S., the concentrations of each constitutent being indicated in grams per liter.

| Bath | Nickel chloride ($NiCl_2$, $6H_2O$) | Nickel sulfate ($NiSO_4$, $7H_2O$) | Sodium molybdate ($Na_2MoO_4$, $2H_2O$) | Trisodic citrate ($Na_3C_6H_5O_7$, $5H_2O$ |
|---|---|---|---|---|
| Chloride (A.C.) | 47.5 | O | 7.3 | 89 |
| | 0.2M/l | | 0.03 M/l | 0.25 M/l |
| Mixed chloride sulfate (A.C.S. 50%) | 23.7 | 28 | 7.3 | 89 |
| Sulfate (A.S.) | 0 | 56 | 7.3 | 89 |
| Chloride (B.C.) | 38 | 0 | 4.8 | 71 |
| Mixed chloride sulfate (B.C.S.) | 19 | 22.5 | 4.8 | 71 |
| Sulfate (B.S.) | 0 | 45 | 4.8 | 71 |

In the examples which will follow, certain experimental parameters have been varied, namely: the composition of the bath, the nature of the support, the number of possible sub-layers, the temperature and the duration final heat improving treatment.

In all cases, the electrolytic coating obtained of molybdenum and nickel gives very good results with respect to corrosion in hydrochloric acid. The speed of corrosion relative to these coatings, evaluated by the density of the corrosion current $i_{cor}$ is very close to that of the industrial alloy "Hastelloy B".

In the following examples, the corrosion speed of the coatings has been determined in hydrochloric acid of concentration equal to 20%, the "Hastelloy B" alloy having, in such an acid, a value of $i_{cor}$ of the order of 2 to 4 $\mu$ A/cm$^2$.

Example 1

Deposit of nickel and of molybdenum on a iron support.

The support is first cleaned successively with 30% nitric acid and with concentrated hydrochloric acid.

This is followed by the electro-deposition in a bath of the AC type at 40°C with a pH of 9.5. There is first formed a fissured sub-layer by using a current density of 4 A/dm$^2$, for 60 minutes.

There is then formed a non-fissured layer by using a current density of 6 A/dm$^2$, for 60 minutes.

A heat treatment is carried out for 6 hours at 950°C under a vacuum of $10^{-5}$ torr.

The deposit obtained is of bright appearance and average thickness of 35 microns. Its content of molybdenum is 25% + or − about 5%. Its corrosion resistance is excellent ($i_{cor}$ in deaerated medium 0.5 to 2 $\mu$ A/cm$^2$.

Example 2

Deposit of nickel and of molybdenum on an iron support covered with a prior deposit of nickel of 10 microns.

The operational conditions are the same as in Example 1, with this difference that there is used a bath of the BC type or of the ACS type.

The results obtained are analogous to those of Example 1.

Example 3

Deposit of nickel and of molybdenum on an iron support.

Operational conditions are the same as in Example 1, with the differences that there is used a bath of the AS or BS type and that the deposit of the non-fissured layer is followed by annealing at 300°C for 45 minutes, after which there is deposited a second non-fissured layer of nickel and of molybdenum before carrying out the final heat treatment at 950°C.

The deposit obtained has a semi-mat appearance. Its average thickness is 40 microns and its molybdenum content 24% (+ or − about 5%).

The corrosion resistance of this deposit is very good ($i_{cor}$ in a deaerated medium 2 to 5 $\mu$ A/cm$^2$.

Example 4

Deposit of nickel and of molybdenum on a nickel support.

A bath of the ACS type is used and the operational conditions are the same as in Example 1.

The deposit, of bright appearance, has an average thickness of 35 microns and its content of molybdenum is 24% (+ or − about 5%).

The corrosion resistance is very good ($i_{cor}$ in a deaerated medium of 1 to 3 $\mu$ A/cm$^2$).

Example 5

Deposit of nickel and of molybdenum on a support of copper or copper alloy.

The support is cleaned with 30% nitric acid and coated with a sub-layer of nickel of about 20 microns thickness.

A bath of the AS or BS type is used and procedure is under the same conditions as in Example 1.

The corrosion resistance of the deposit is excellent ($i_{cor}$ 2 to 6 $\mu$ A/cm$^2$ in a deaerated medium) and this result is due, in part, in the case of such a support of copper or based on copper, to the presence of the initial nickel sub-layer.

Example 6

Deposit of nickel and of molybdenum on a titanium support.

An initial cleaning of the support is carried out with hydrofluoric acid at 60°C for 5 minutes The electro-deposition is effected with the same bath and under the same operational conditions as in Example 1.

The final thermal treatment is conducted at 800°C for 10 hours under $10^{-5}$ torr vacuum.

The deposit obtained is of bright appearance and its corrosion resistance, satisfactory, is from 10 to 30 $\mu$ A/cm$^2$.

Example 7

Deposit of nickel and of molybdenum on a "Maraging" steel support.

The support is cleaned by anodic attack in a 25% sulfuric acid solution, for 30 seconds, with a current of 21.5 A/dm$^2$.

The electro-deposition is effected under the same conditions as in Example 1.

The final heat treatment is conducted at 860°C for 6 hours under a vacuum of $10^{-5}$ torr.

The corrosion resistance of the deposit is satisfactory ($i_{cor}$ in a deaerated medium 5 to 20 $\mu$ A/cm$^2$).

Example 8

Deposit of nickel and of molybdenum on a stainless steel support.

The support is cleaned successively at 25°C, in a solution of 25% acid and 3% hydrofluoric acid, then, at 70°C, in a concentrated hydrochloric acid solution.

A bath of the AS type at 40°C and pH 9.5 is used and the electro-deposition conditions are the same as in Example 1.

The final heat treatment is contacted at 100°C for 6 hours under of vacuum of $10^{-5}$ torr.

The corrosion resistance of the deposit is excellent ($i_{cor}$ in a deaerated medium 1 to 3 $\mu$ A/cm$^2$).

Example 9

Deposit of nickel and of molybdenum on a support of construction steel of the "35 NCD 16" type.

The electro-deposition conditions are the same as in Example 1 and the final heat treatment is conducted at 870°C, for 6 hours under a vacuum of $10^{-5}$ torr.

The corrosion resistance of the deposit is good ($i_{cor}$ in a deareated medium 5 to 15 $\mu$ A/cm$^2$).

The final heat treatment may be dispensed with, since it is advantageous but not necessary; then the chemical resistance of the coating (untreated or after a simple annealing) is less than that of coatings which have undergone the final heat treatment, but however sufficient to offer satisfactory behavior in moderately aggressive environments, such as certain cold organic acids (acetic, chloracetic, formic acids, etc.) and bases such as soda, potash, etc.

Referring now to the electro-deposition of multilayer coatings consisting of alternate layers deposited under different conditions for non-fissured layers (except the top layer) to be sandwiched between layers which are either fissured or closer to the fissuration threshold.

Since the coating operation is much more easily carried out if all layers are deposited in the same bath, it appears preferable to use either of the following approaches:

a first approach consists in using two different values of the cathodic current density for depositing successive layers, whose thickness may be the same or not. If, for instance, it is preferred to have layers of equal thicknesses, a possibility consists in using current densities $i_1$ and $i_2$, which are the current densities for depositing the fissured and non-fissured layers of the coating, respectively, as shown in the single FIGURE, with: $i_1 < i_F < i_2$; a satisfactory range appears to be:

$$1.2/1 < i_2/i_F < 2/1$$

$$0.4\ i_F < i_1 < 0.9\ i_F$$

with $i_F$ being the fissuration threshold for the selected thickness $e_s$.

In most cases, the following ranges appear preferable for depositing Ni-Mo layers:

$$2\ \text{A/dm}^2 < i_1 < 6\ \text{A/dm}^2$$

(the exact value of $i_1$ in that range being selected primarily according to the desired molybdenum content);

$$1.2\ i_s < i_2 < 2.5\ i_s.$$

In that case, the value of $i_s$ will be the most important parameter in determining, for a predetermined bath, the molybdenum content, as well as the differences $i_1 - i_s$ and $i_2 - i_s$, since the layers have the same thicknesses.

a second approach consists in passing current densities which are close to each other (but slightly different for providing a separation between adjacent layers) when depositing successive layers which are given thicknesses altenatively lower than and higher than the fissuration thickness for the selected current densities.

In other words, alternate non-fissured thin layers having a thickness $e_{s1}$ lower than the threshold thickness $i_F$ and fissured layers having a thickness $e_{s2}$ higher than $e_s$ are deposited. That approach is of interest since it provides layers whose molybdenum percentage is substantially constant throughout the coating. As a counterpart, the cumulated thickness of the fissured layers is greater than that of the non-fissured layers.

last, an approach consists in selecting different current densities and different thicknesses for adjacent layers. For instance, two adjacent layers may respectively correspond to points A and B in the single FIGURE of the drawing.

In each case, optimum values should be determined by test. However, using the above-mentioned ranges and thicknesses between 1 and 10 microns for the elementary layers provide generally satisfactory results and make it possible to obtain cumulative thicknesses which may exceed 200 microns, up to 250 microns under optimum conditions. If however layers having a high molybdenum content are desirable, shallow elementary layers and a low current density will be used.

It appears probable, although not certain, that the "fissured" layers prevent propagation of the stresses from a non-fissured layer to the next to a very noticeable extend and, consequently, render traversing cracks less prone to occur and preserve the integrity of the "multi-layer" coatings.

Particular examples of Ni-Mo and Co-Mo multi-layer coatings will now be given.

Example 10

The molar composition of the bath is similar to that of bath AC referred to above, the greater portion of nickel chloride being however replaced with nickel sulfamate. The composition is as follows:

| | |
|---|---|
| Nickel sulfamate | 73,6 mg/l, i.e., 0.18 mole/l |
| nickel chloride | 4,76 g/l, i.e. 0.02 mole/l |
| sodium molybdate | 7,3 g/l, i.e. 0.03 mole/l |
| trisodic citrate | 90 g/l, i.e. 0.25 mole/l . |

Nickel sulfamate is brought to the bath as an aqueous solution containing 55% of nickel sulfamate by weight. The part to be coated consists of an iron part which is first cleaned up as in example 1. The pH of the bath is 9.5 and the temperature is 40°C. The following sequence is repeated several times: a fissured layer is electrodeposited for 270 seconds with a current density of 4 A/dm² and a non-fissured layer for 135 seconds with a current density of 8 A/dm². As a result, the coating consists of elemental layers all having substantially the same thickness, about 2 microns, with different molybdenum contents. Multilayer coatings of 200 microns have been obtained which are adherent, tight, resistant to hydrochloric acid environment, without any tendency to break down.

Example 11

The bath and support are the same as in example 10. The temperature is 40°C and the multilayer coating is deposited by repeating the following sequence: 4 A/dm² for 400 seconds and 8 A/dm² for 200 seconds. The elementary layers have a thickness of about 3 microns and it is again possible to obtain satisfactory coatings of 200 microns.

Example 12

Under the same conditions as in example 10, but repeating a sequence of 4 A/dm² for 800 seconds and 8 A/dm² for 400 seconds, a satisfactory multilayer coating of up to 200 microns consisting of layers each 5–6 microns thick is obtained.

Example 13

Again under the same conditions, but with 3 A/dm² for 1200 seconds and 6 A/dm² for 600 seconds, a satisfactory multilayer coating of up to 200 microns is obtained which each elementary layer having a thickness in the 7–8 microns range.

Example 14

A bath having the same molar compositon as bath BC, the greater part of the chloride being however replaced with sulfamate, is used. The composition is as follows:

| | |
|---|---|
| nickel sulfamate | 67.1 ml/l, i.e. 0.164 M/l |
| $NiCl_2$, $6H_2O$ | 4.5 g/l, i.e. 0.060 M/l |
| sodium molybdate | 4.8 g/l, i.e. 0.02 M/l |
| trisodium citrate | 71 g/l, i.e. 0.2 M/l. |

The nickel sulfamate is introduced in the form of an aqueous solution containing 55 wt % of sulfamate.

Multilayer coatings are deposited at 40°C, at pH 9.5. Coatings up to 200 microns thick, without cracks, are obtained by repeating the following sequence: 2.5 A/dm² for 900 seconds and 5 A/dm² for 450 seconds. The average thickness of the elementary layers is about 4 microns.

Example 15

A coating is deposited with the bath of example 10, by repeating the following sequence 2.5 A/dm² for 180 seconds and 4 A/dm² for 100 seconds. The thickness of the elementary layers is about 0.9 microns.

Example 16

Cobalt-molybdenum coatings have been electrodeposited on a iron support in a bath having the following composition:

| | |
|---|---|
| $Co\ Cl_2$, $6\ H_2O$ | 95 g/l |
| $Na_2\ Mo\ O_4$, $2\ H_2O$ | 7.3 g/l |
| sodium citrate | 160 g/l . |

The pH was adjusted at 10 by adding $NH_4OH$ and electrodeposition was carried out at 40°C, alternately passing current densities of 8 A/dm² for 300 sec. and 12 A/dm² for 200 sec. Satisfactory coatings having a thickness up to 80 $\mu$m and consisting of layers about 1$\mu$m thick have been obtained.

As indicated above coatings with a high molybdenum content obtained with a low current density correspond to a small fissuration threshold $e_s$. It is on the contrary possible to deposit satisfactory multilayer coatings by sandwiching non-fissured molybdenum-rich layers (having a thickness lower than $e_s$, for instance 0.3 to 0.8 $e_s$) and layers having a lower molybdenum percentage, which are however also not fissured. It should be noted that the last type layers have relatively moderate internal stresses and to a certain extent have a damping effect. Such multilayer coatings are of advantage in that they have a relatively high average molybdenum content, higher than that of the elementary layers of the second type.

The coatings of nickel and of molybdenum according to the invention have good corrosion resistance in oxidizing atmospheres up to about 750°C and in reducing atmospheres up to higher temperatures. They also exhibit good corrosion resistance in a number of organic and mineral corrosive liquid environment, such as hydrochloric acid, sulfuric acid (except if the acid concentration is higher than 60% or in boiling acid), phosphoric, hydrofluoric, chromic, acetic, formic, lactic, citric and tartaric acids, the fatty acids (oleic, stearic), acid chlorides such as ammonium chloride, zinc chloride, sodium chloride, bases such as NaOH or liquid ammoniac or in non-oxidizing aqueous solution.

It will be understood that, under these conditions, such coatings can find applications in the chemical industries, food industries, those of petroleum (petrochemicals, extraction, refining), domestic equipment industries, etc.

Thus, especially, the invention can be applied to the elements of installations for the manufacture and the handling of corrosive chemical products such as hydrochloric acid, phosphoric acid, organic acids, sodium chloride solutions.

By way of examples of such elements, there may be mentioned turbines, blades of wheels, members of tap work, condenser tubes for boilers, marine equipment.

We claim:

1. An electrolytic method for producing, on an electrically conductive support, a codeposit layer of molybdenum and at least one transition metal selected from the group consisting of Ni, and Co, in which the support to be protected is at the cathode and the bath in which this cathode is immersed contains at least one compound of molybdenum and at least one compound of said transition metal, said method comprising, providing in the bath an aqueous soluton of: an alkali metal molybdate at a concentration from 0.008 M/l to 0.05 M/l, a salt of said transition metal and an alkali-metal salt of an organic acid with mixed acid-alcohol functional groups, said salt being capable of giving complexes with the molybdenum and transition metal ions of the other constituents, adjusting the pH of the bath between 9 and 11 and maintaining the temperature of the bath at a temperature above 20°C compatible with the stability requirements of said complexes, using a cathodic current density greater than 5 A/dm², pursuing the electro-deposition treatment for a duration which is less than a threshold, called "scaling duration", above which there is produced a scaling of the deposit formed, said threshold being a decreasing function of the thickness of said layer, and subjecting said layer of alloy and the sub-adjacent support to a thermal treatment conducted in a non-oxidizing medium, at a temperature between 700°C and 1200°C and compatible with the preservation of the properties of said support, the duration of this thermal treatment being between 2 and 24 hours.

2. Electrolytic method according to claim 1, wherein the salt of the transition metal contained in the bath is at least one salt selected from the group consisting of chloride, sulfamate and sulfate of said transition metal.

3. Electrolytic method according to claim 2, utilizing a molybdenum-nickel bath at about 40°C and having a pH of about 9.5, wherein the cathodic current density is of from about 6 A/dm² to about 7 A/dm².

4. Electrolytic method according to claim 1, wherein a single layer coating is electrodeposited for a time approximately equal to three quarters of the duration after which scaling occurs.

5. Electrolytic method according to claim 4, wherein the duration of the electro-deposition treatment is between 60 and 90 minutes.

6. Electrolytic method according to claim 1, wherein prior to electrodeposition of the layer coating, a sublayer of at least one metal acting as a diffusion barrier with respect to undesirable elements of support is deposited on said support.

7. Electrolytic method according to claim 6, wherein said sublayer contains at least one of the metals copper, cobalt and nickel.

8. Electrolytic method according to claim 1, wherein the temperature of the bath is from 20°C to 60°C.

9. Electrolytic method according to claim 1, wherein the alkali metal salt of an organic acid with mixed acid-alcohol functional groups contained in the bath is trisodic sodium citrate.

10. Electrolytic method according to claim 1, wherein the concentrations of the constituents of the bath and operational conditions are so selected that a molybdenum alloy containing from 15 to 50% by weight of molybdenum is electrodeposited.

11. Electrolytic method according to claim 1, wherein the anode of the bath is an insoluble anode or an anode consisting of an alloy of molybdenum and said transition metal.

12. Electrolytic method according to claim 1, wherein prior to deposition of said alloy layer, a fissured alloy layer is deposited in the same composition bath but with a cathodic current intensity less than 5 A/dm².

13. Electrolytic method according to claim 1, wherein several layers of molybdenum-transition metal alloy are successively electrodeposited, wherein each layer is subjected to annealing carried out in a non-oxidizing atmosphere at a temperature between 150°C and 350°C for a duration of between 30 minutes and 3 hours prior to electrodeposition of the next layer.

14. Electrolytic method according to claim 1, comprising forming the alkali metal molybdate in situ.

15. Electrolytic method according to claim 1, wherein said alkali metal molybdate is sodium molybdate.

16. Electrolytic method for producing on an electrically conductive support, a non-fissured codeposited coating of molybdenum and nickel comprising the steps of:

forming an aqueous solution of alkali metal molybdate at a concentration from 0.008 M/l to 0.05 M/l, nickel salt and an alkali metal citrate with proportions adjusted so that the resultant coating contains between 15 and 50% by weight of molybdenum, adjusting the pH between 9 and 11, locating said support at the cathode in an electrolytic bath of said aqueous solution, passing current in said bath with a cathodic current density greater than 5 A/dm² and at a temperature of at least 20°C for a duration of from 60 to 90 minutes.

17. Electrolytic method according to claim 16, wherein the nickel salt is one at least of the salts selected from the group consisting of nickel chloride, nickel sulfamate and nickel sulfate.

18. Method for electrodepositing on an electrically conductive support a coating of molybdenum and at least one transition metal selecting from the group consisting of nickel and cobalt, comprising the step of making the support cathodic in an aqueous solution of an alkali metal molybate at a concentration from 0.008 M/l to 0.05 M/l, an alkali metal salt of an organic acid with mixed acid-alcohol functional groups, said salt being capable for complexing with the molybdenum and transition metal ions of the other constituents of the solution, and at least one salt of said transition metal selected from the group consisting of transition metallic chlorides, sulfates and sulfamates, the pH of the solution being between 9 and 11 and the temperature of the solution being from 30°C to 60°C, wherein two predetermined cathodic current densities, one at least of which is greater than 5 A/dm², are alternately used for depositing alternate layers of different properties, the duration of the electrodeposition with each predetermined current density being selected from the layer to have a thickness between 1 and 10 microns.

19. Process according to claim 18, wherein one of the cathodic current densities is lower than 5 A/dm² and said density and the thickness of the corresponding layer are so selected that the layer is fissured.

20. Method according to claim 19, wherein all said layers have substantially the same thickness.

* * * * *

UNITED STATES PATENT OFFICE

CERTIFICATE OF CORRECTION

PATENT NO. : 3,947,331

DATED : March 30, 1976

INVENTOR(S) : Vu Quang Kinh and Jean Montuelle

It is certified that error appears in the above-identified patent and that said Letters Patent are hereby corrected as shown below:

On the Cover Sheet, in item [30] please insert

-- November 30, 1970 France ..... 70.42950 --

Signed and Sealed this

Fourteenth Day of September 1976

[SEAL]

*Attest:*

RUTH C. MASON
*Attesting Officer*

C. MARSHALL DANN
*Commissioner of Patents and Trademarks*